United States Patent [19]

Goerss

[11] 4,337,784

[45] Jul. 6, 1982

[54] METHOD FOR CLEANING FLOOR SURFACES WITH HIGH PRESSURE WATER JETS

[75] Inventor: William G. Goerss, Fenton, Mich.

[73] Assignee: N L B Corp., Wixom, Mich.

[21] Appl. No.: 145,392

[22] Filed: May 1, 1980

Related U.S. Application Data

[62] Division of Ser. No. 934,756, Aug. 21, 1978, Pat. No. 4,219,155.

[51] Int. Cl.[3] ..... B08B 3/02

[52] U.S. Cl. ..... 134/34; 134/38

[58] Field of Search ..... 134/172, 173, 180, 181, 134/34, 38; 15/320, 345, 385; 239/124, 150, 231, 247, 261, 264, 285, 287; 285/150

[56] References Cited

U.S. PATENT DOCUMENTS

| | | | |
|---|---|---|---|
| 2,602,003 | 7/1952 | Wellborn | 239/246 X |
| 2,768,101 | 10/1956 | Fairchild | 134/38 X |
| 3,442,539 | 5/1969 | Randall | 285/190 |
| 3,748,050 | 7/1973 | Poppitz | 239/251 X |
| 3,829,134 | 8/1974 | Hutchison | 285/190 X |
| 4,037,290 | 7/1977 | Rose et al. | 15/345 |
| 4,047,665 | 9/1977 | Moynihan | 239/124 |
| 4,107,816 | 8/1978 | Matthews | 239/225 X |

*Primary Examiner*—Marc L. Caroff

*Attorney, Agent, or Firm*—Cullen, Sloman, Cantor, Grauer, Scott & Rutherford

[57] ABSTRACT

A high-pressure water cleaning device has an enclosure with an open bottom for movement over a floor surface and floor gratings. The cleaning device may be stationary, with objects to be cleaned moved past the enclosure. A rotating seal includes an upright spindle within said enclosure and secured thereto having an axial bore with a high-pressure water inlet and a series of radial discharge ports. A rotatable tubular body is journalled upon said spindle and has an internal annular high-pressure chamber communicating with the discharge ports and a series of radial outlets communicating with the chamber. Tubular arms mounting nozzles are laterally projected into said outlets for rotation with the body, the nozzles being adjusted for delivering streams of high pressure water within the enclosure at high pressure onto floor surfaces and gratings. The tubular body is power rotated. A high pressure dump valve assembly upon the enclosure receives high pressure water from a high pressure water source and has a normal mode zero pressure outlet orifice communicating with the interior of the spray enclosure and a high pressure active mode outlet which communicates with the spindle inlet for delivering high pressure water thereto. Paint is removed from floor and floor grating surfaces by directing a stream of high pressure water from said nozzles toward said surfaces. Rotation of the tubular body and closure of the dump valve outlet orifice are effected simultaneously by pneumatic activation of the cleaning device.

1 Claim, 4 Drawing Figures

METHOD FOR CLEANING FLOOR SURFACES WITH HIGH PRESSURE WATER JETS

This is a division, of application Ser. No. 934,756, filed Aug. 21, 1978, now U.S. Pat. No. 4,219,155.

BACKGROUND OF THE INVENTION

Heretofore, in the cleaning of floor surfaces and gratings and particularly floor surfaces and gratings within spray booths, the accumulation and build up of paint particles upon the floor surface and gratings has created the problem of effectively removing such accumulated paint from time to time. Various types of caustic and other paint stripping systems have been employed including hot salt bath stripping or the mechanical stripping of accumulated paint upon floors and gratings with accompanying problems producing air polution and the utilization of a second set of removable floor grates that can be used to replace the paint-laden grates.

Various efforts have been heretofore made in order to mechanically remove paint from the floors and gratings of spray booths as well as other dirt and oil accumulations on floor surfaces generally.

SUMMARY OF THE INVENTION

It is an object of the present invention to provide a cleaning device for floors and gratings which incorporates within an open bottom enclosure a rotating seal and a plurality of rotating high pressure water jets which are angularly adjusted in a predetermined pattern for directing high pressure streams of water onto and against surface areas of gratings and floors for mechanically removing paint and dirt accumulation therefrom.

It is another object to provide an improved cleaning device for floors and gratings which eliminates polution problems, eliminates use of caustic chemicals, eliminates one set of floor grates, saves man power normally required in constantly switching clean for dirty grates, eliminates costly caustic and other type of paint-stripping systems and chemicals and eliminates the cost of energy for hot salt bath stripping.

It is another object to incorporate the cleaning device in an automatically driven vehicle to enable the high pressure rotating spray pattern to remove paint from various objects normally used for transporting automobile bodies and parts through paint booths. This method utilizes the same rotating seal as mentioned above.

It is another object of this invention to incorporate the rotating high pressure spray in a stationary enclosure which would be utilized to clean moving paint booth gratings.

It is another object to provide a spin-jet unit which could be manually propelled, electric motor propelled, trailed or be stationary with objects to be cleaned moving past the cleaning device.

It is a further object to provide a cleaning device which requires less man power which is fully safe in operation and incorporating safety controls and with the cleaning sprays contained within an enclosure directed onto the surface areas of floors and gratings.

These and other objects will be seen from the following specification and Claims in conjunction with the appended drawings.

THE DRAWINGS

It is understood that the above drawing illustrates merely a preferred embodiment of the invention directed to the cleaning device for floors and gratings and the method of paint removal, and that other embodiments are contemplated within the scope of the Claims hereafter set forth.

DETAILED DESCRIPTION OF THE INVENTION

Figure 1:
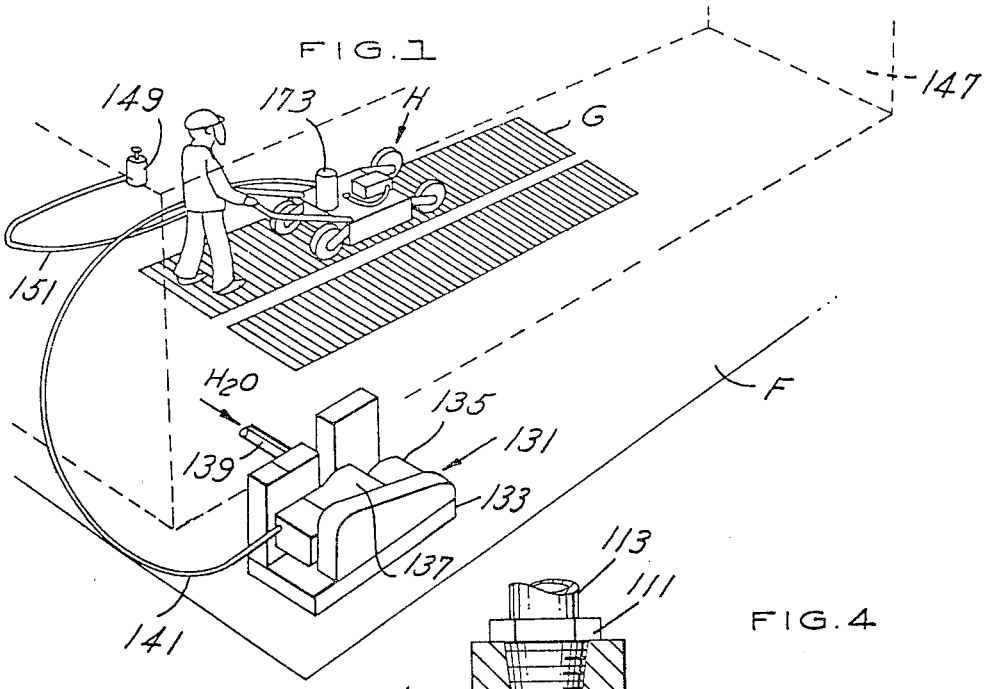
FIG. 1 is a schematic fragmentary perspective view showing a floor and grating as a part of a paint spray booth to which the present cleaning device is applied.

Referring to the drawings, FIG. 1 shows fragmentarily a floor F and conventional type of gratings G found within spray-painting booths such as the booth 147, fragmentarily shown wherein, there is an accumulation from time to time of paint drippings upon the floor and grating surfaces requiring cleaning and removal.

The present invention is one embodiment is directed to a manually or otherwise propelled cleaning device for floors and gratings as well as the method of removing paint and other particles and dirt from such floors and gratings. As shown in FIG. 1, there is movably positioned upon the grating and/or the floor surface F the present manually propelled cleaning device 11 referred to as a spin jet floor and grating cleaning unit.

Figure 4:
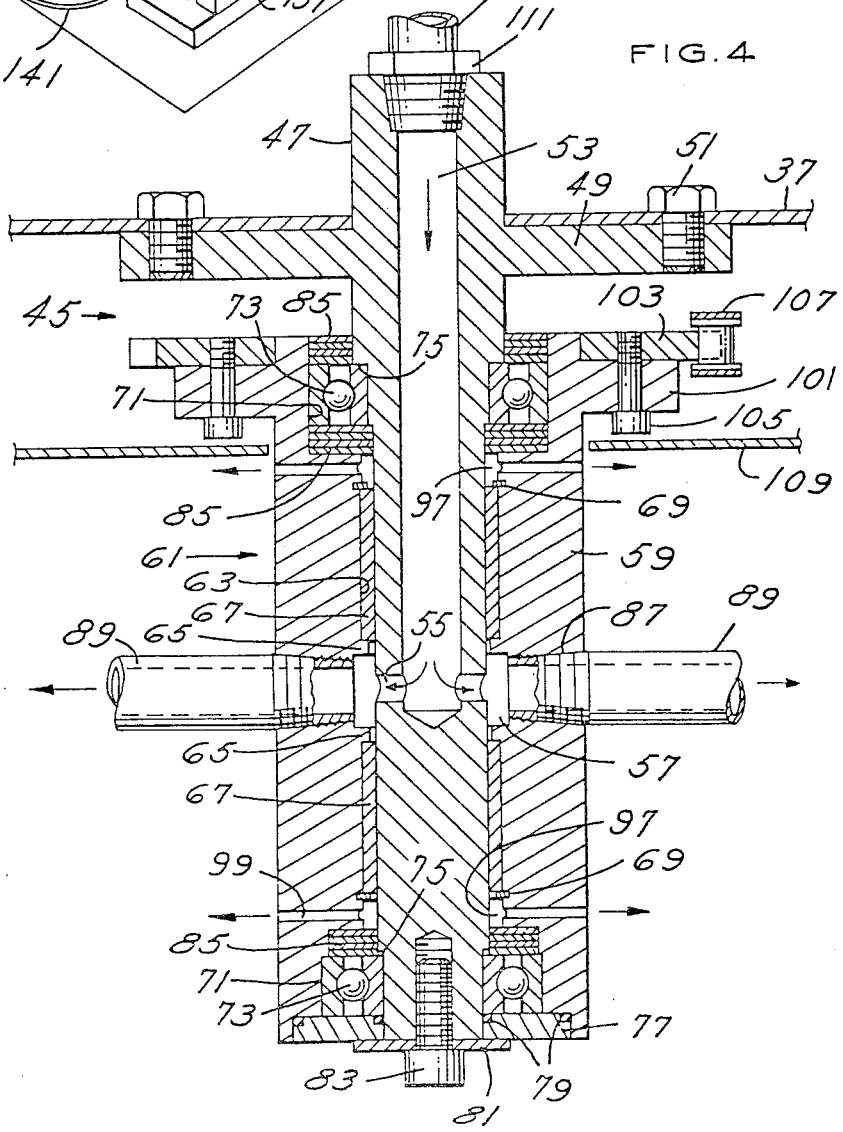
FIG. 4 is a fragmentary section of the rotating seal including the spindle and body taken in the direction of arrows 4—4 of FIG. 2, on an increased scale.

Said cleaning unit includes the spray enclosure 13 having upright side walls and a top wall 37, FIGS. 1 and 4, and an open bottom. Peripheral splash guard skirting 15 is arranged around the side walls of the enclosure removably secured thereto as by fasteners 15, with the lower edges of the splash guard adjacent or below the lower edges of the enclosure side walls and normally spaced a short distance above the floor surface F, FIG. 2.

Bifurcated wheel supports 21 project angularly downward from the end walls of the enclosure and are suitably secured thereto as by welding for supporting the wheels 23 having axles 25. The wheels include heavy duty tires for movably mounting the spray enclosure with its bottom closely adjacent the floor surface as indicated by the clearance 27, FIG. 2. The open bottom of the spray enclosure is in communication with spray chamber 19 to facilitate the application of streams of high jet pressure fluids upon the floor surface F and the gratings G over which the cleaning device is movably and manually transported.

The U-shape tubular handle 29 has closed ends whose bifurcations 31 are pivotally connected at 33 to the brackets 35 upon the top wall 37 of the enclosure. The adjustable handle support 41 interconnects at least one of the axles 25 and handle 29 as by the adjustable clamp 43 to facilitate angular adjustment of the handle to meet the needs of the attendant using the cleaning device as in FIG. 1.

Figure 2:
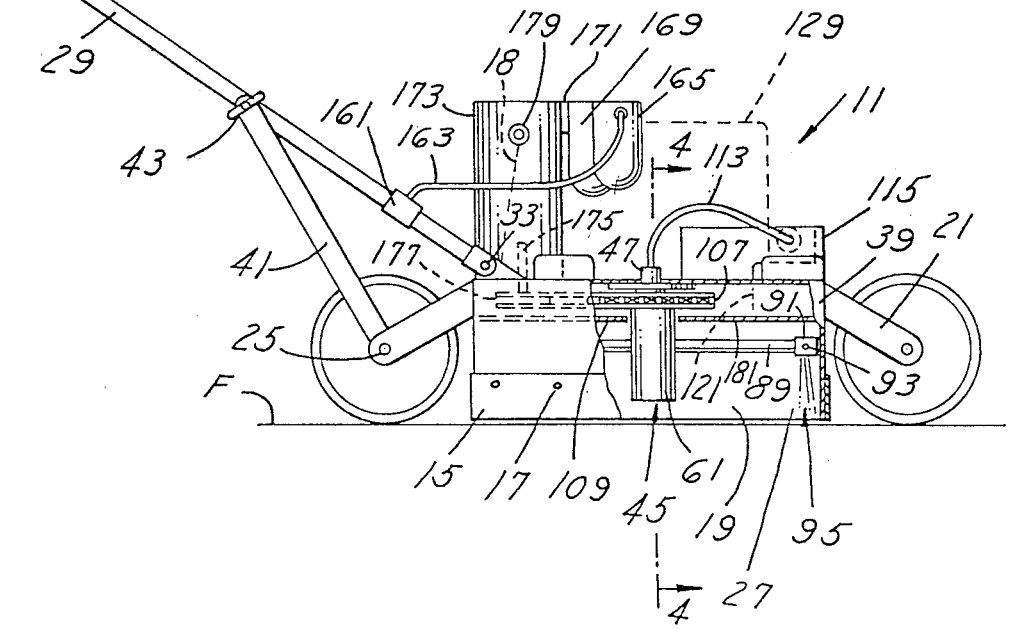
FIG. 2 is a side elevational view of the manually propelled cleaning device for floors and gratings shown in FIG. 1, on an increased scale.

The heart of the present invention is the rotating seal assembly generally indicated at 45, FIGS. 2 and 4, which is mounted within chamber 19 of the spray enclosure. The rotating seal assembly includes the upright spindle 47 whose mount flange 49 bears against the undersurface of top wall 37 and is secured thereto by fasteners 51.

The spindle projects through top wall 47, and includes a longitudinal bore 53 which terminates intermediate the ends of said spindle in a series of radial discharge ports 55, FIG. 4. The upper end of said spindle has a high pressure inlet adapted to receive the fitting 111 and the water pipe 113, fragmentarily shown.

In addition to said spindle, the rotating seal assembly includes the rotating seal 61 having an elongated body 59 and a longitudinal bore 63 which receives and encloses a major portion of the spindle below top wall 37 within the chamber 19 of the spray enclosure.

Said body intermediate its ends has formed therein an annular high pressure water chamber 57 arranged radially outward of the high pressure discharge ports 55. Also formed through said body are a plurality of outlets 87 in communication with water chamber 57, into which are projected threadedly or otherwise secured the inner ends of the radially extending nozzle arms 89, fragmentarily shown in FIG. 4 and also shown in FIG. 2.

Within and adjacent the bore 63 of said body are a pair of spaced shoulders 65 against which bear a pair of elongated bushing seals 67, preferably made of a phosphor bronze, snugly held within said bore and retained in position by the lock rings 69. The opposite ends of said body have counter bores 71 within which are nested precision ball bearings 73. Portions of said bearings receive said spindle and cooperatively engage the corresponding shoulders 75 thereon by which the body is supported and journalled with respect to the stationary spindle.

Cover 77 employing inner and outer O-rings 79 is nested and sealed within the lower end of said body and around the lower end of the spindle 47 and is retained relative to said body and the lower ball bearings 73 by washer 81 and an axial fastener 83. A series of water seals 85 extend into the corresponding bores 71 within said body above and below the top ball bearing assembly 73, and above the bottom ball bearing assembly to keep the respective ball bearings dry and to exclude water therefrom.

Figure 3:
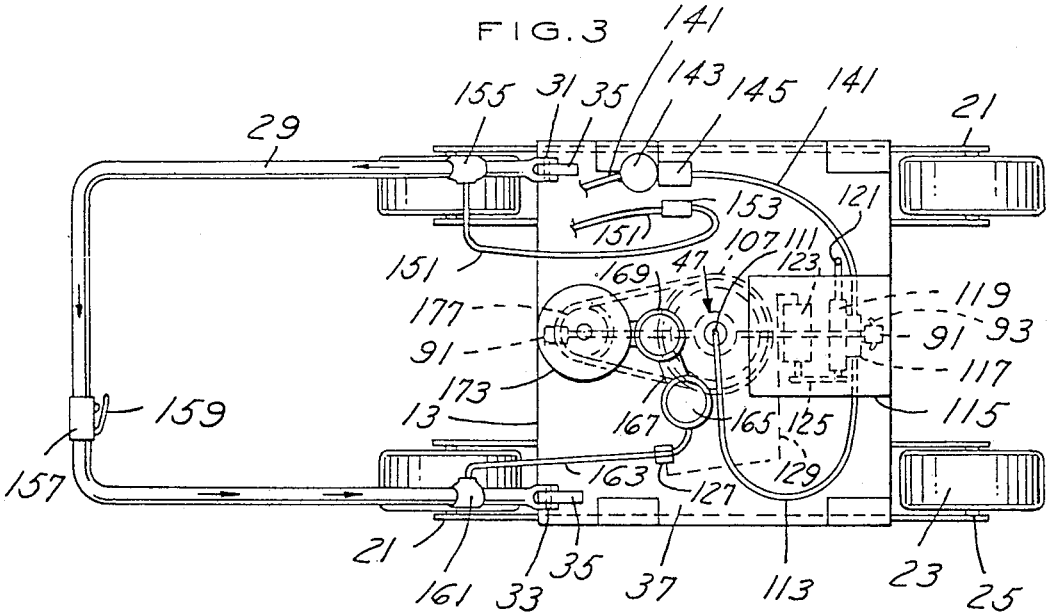
FIG. 3 is a plan view thereof.

As shown in FIGS. 2 and 3, adjustable nozzle blocks 91 are mounted upon the ends of the nozzle arms 89, each adapted to adjustably support one or a plurality of angularly disposed nozzles 93. The nozzles are adjusted so as to establish a predetermined spray pattern such as shown at 95, FIG. 2, for the impingement of high pressure jets of water onto the floor and grating surfaces with the nozzle arms 89 adapted to rotate and sweep over the floor or grating surface as the spray enclosure is slowly propelled manually thereover.

Referring to FIG. 4, between the spindle and the rotating body longitudinally outward of the ends of the respective bushing seals 67 are a pair of water drain cavities 97 which communicate with the radial opposed pairs of drains 99 to permit escape of high pressure lubricating water as may pass between the bushings and said spindle, said drains communicating with chamber 19 of the spray enclosure. Body 59 at its upper end has an annular gear mount flange 101 over which is assembled to sprocket gear 103 secured thereto by fasteners 105.

In FIG. 4, a continuous sprocket chain 107 is fragmentarily shown which extends around said sprocket gear and forms a part of the intermeshing gear arrangement of FIG. 2 for power rotating the seal 61 and corresponding rotation of the nozzle arms 89. A chain guard plate 109, apertured to receive rotating seal 61 spans the respective side walls of the spray enclosure and is secured thereto for protectively separating the drive mechanism including the chain and sprockets from the water being sprayed within chamber 19 down onto the floor and grating surfaces.

A high pressure water dump valve housing 115 overlies and is secured to the top wall 37 of the spray enclosure. Schematically shown in FIG. 3 and within the dump valve housing, there is provided a dump valve 119 having a dump valve bypass outlet 117 adapted for delivering high pressure water through the conduit 113 to the inlet fitting 111 at the top of the spindle 47 as in FIGS. 2, 3 and 4.

The dump valve also includes a low or zero pressure enlarged orifice 121 which is in communication with the chamber 19 of the spray enclosure. The dump valve includes longitudinally movable dump valve element 125 therein which in the static mode is normally biased to such a position as to leave the zero pressure dump valve orifice 121 open leaving a small amount of water to pass through conduit 113 to inlet 111 under zero or low pressure.

The normally open dump valve orifice outlet is generally indicated at 21, FIG. 3, as extending from the dump valve body down into the chamber 119.

A suitable power means is employed for changing the position of the movable valve element within the dump valve body. Such power means includes a pneumatic control cylinder 123 mounted upon the dump valve housing having a piston and piston rod which is connected to the dump valve element 125.

From a suitable fitting 127 applied to the high pressure air conduit 163, FIG. 3, there extends an air conduit 129 which is connected to the control cylinder 123 so that when the high pressure air is moving through conduit 163 and conduit 129, the power cylinder 123 is activated and the valve element 125 moved so as to close the dump valve low pressure orifice and force all the water flow into the nozzles thereby creating a restriction and causing the water pressure to rise to a preset level.

As shown in FIG. 1, there is provided a high pressure pump assembly 131 having a base 133 positioned upon the floor surface F, and includes a motor 135 for driving a pump 137 having a suitable intake 139 to a water supply. A high pressure water delivery hose or pipe 141 extends from the pump.

As shown in FIG. 3, connected to the water supply hose 141 is a filter 143. Said filter incorporates a 200 mesh filter rated for 10,000 psi operating pressure for removing particles from incoming water since clean water is essential to long operating life of the rotating seal. High pressure water from the filter 143 upon bracket 145 continues through the conduit 141 into the dump valve housing 115 for connection to the inlet of the dump valve 119.

A high pressure air supply with pressures between 60 and 90 psi is generally indicated at 149, FIG. 1, and is adapted for delivering such high pressure air through the air hose 151 through the supporting bracket 153 upon the top wall of the spray enclosure for connection with the fitting 155 upon one leg of the U-shaped tubular handle 29, whose free ends are closed.

Mounted upon the bight of the U-shaped handle at a convenient location for the attendant is the normally closed quick-release air valve 157 with handle 159 which controls the flow of high pressure air through the tubular handle 29 and to the outlet fitting 161 on the other legs of said handle.

Air conduit 163 connects the fitting 161 for delivering high pressure air to the air filter 165. The air filter is rated for 105 cfm flow rate with a maximum air pressure 250 psi. The filter incorporates, for illustration, a 50 micron filter for removal of liquid and solid particles. HIGH pressure air from the air hose 163 passes through the filter, through an additional conduit 167 passes through the air lubricator 169 upon the bracket 171 through a corresponding conduit to the air drive motor 173.

Said motor is mounted and suitably secured upon the top wall of the spray enclosure. The air motor is of a conventional construction and in the illustrative embodiment, is an axial piston air motor rated for the required horse power with 90 psi air pressure and 62 cfm air volume. The air motor includes at the lower end thereof an output shaft 175 which extends through the top wall 37 of the spray enclosure and at its lower end, mounts the drive sprocket 177 which through the chain 107 is connected to the driven sprocket 103 upon the seal body.

Applied to the air motor is a suitable exhaust valve 179 with outlet, whereby, regulation of said valve may control the speed of operation of the air motor.

The conduit 181, fragmentarily shown, extends from the exhaust valve of the air motor down into the chamber which encloses the gear mechanism, namely, the sprockets and chain so that particles of oil within the air from the air lubricator 169 may be employed for lubrication of the sprocket chain and sprocket gears.

In the illustrative embodiment, the air lubricator 169 has an adjustable micro-fog unit which includes a transparent bowl with metal guard and has a one-half pint oil capacity rated for 250 psi maximum air pressure. Oilladden exhaust air through the exhaust valve outlet 179 is thus directed by conduit 181 the chain guard enclosure and past the chain 107 for continuous lubrication thereof.

OPERATION

The present rotating seal 45, FIG. 4, consists of two major units, a stationary spindle 47 and the rotating body 59. The rotating body incorporates a pair of close tolerance fine finish bronze seals 67 secured to the body and which rotate about the spindle, one above the spindle discharge ports 55 and one below said ports. The rotating body also includes at the top and bottom thereof, precision ball bearings 73 adapted to react to all of the various side loads imposed on the body by the thrust of the high pressure nozzles 93, FIGS. 2 and 3. Sufficient water for lubrication is allowed to pass from the high pressure chamber 57 through the seals 67 and into the drain cavities 97 for outlet through the drains 99.

The ball bearings are completely protected from water by the seals 85 upon both sides of the upper ball bearing and upon the top of the lower ball bearing.

In the illustrative embodiment, spindle 47 includes four radial discharge ports 55 for flow of water into the high pressure chamber 57 which completely surrounds said discharge ports, assuring a continuous and uninterupted flow of high pressure water to the respective nozzle arms 89. The surfaces of the spindle are precision-machined to provide minimum friction and maximum sealing capabilities.

In normal operation with the cleaning device for floors and gratings, particularly the floors and gratings of spray paint booths and the like manually propelled thereover as shown in FIG. 1, water under high pressure is delivered through the hose 141 connected to the high pressure pump assembly 131. Thus, water under pressure is delivered to the dump valve housing 115 and the dump valve 119 therein. In the normal mode, the foresaid dump valve, its movable valve element 125 is normally biased to such position to allow water to flow at reduced pressure through the large orifice 121 within the dump valve body down into the chamber 19 of the spray enclosure.

At the same time, high pressure air from the source 149 is delivered through conduit 151 to fitting 155 of the handle 129. Said high pressure air communicates through said handle and with the normally closed control valve 157 having a trigger handle 159 for opening the same, normally controlling the flow of high pressure air through the other leg of the U-shaped handle 29, as in FIG. 3. Once the valve 157 has been manually opened, high pressure air is delivered through the fitting 161 and air conduit 163 through air filter 165 through air lubricator 169 and the conduit connection 167 into air motor 173 for driving said motor and its rotatable output shaft 175.

Accordingly, on manual opening of the air valve 157 by squeezing the handle 159, which is normally spring-biased to open position shown, FIG. 3, air motor 173 is activated and its output shaft 175 drives the sprocket 177 and chain 107 and the corresponding sprocket 103 upon the rotating seal body 59. This causes a predetermined speed of rotation of the seal body and the laterally projecting nozzle arms 89. The arms mount adjustable nozzle blocks 91 which mount one or a plurality of spray nozzles 93 to provide as determined the inward and outward spray pattern.

The respective nozzles incorporate tungsten carbide spray tips which are especially designed for removing paint accumulations from floor gratings and from floors and for that matter, for the removal of dirt or oil or other refuse from floor surfaces generally.

At the same time as high pressure air flow is transmitted through the hollow handle 29 and through the conduit 163 and conduits 167 to the air motor, the branch air conduit 129, FIG. 3, from the fitting 127 delivers high pressure air to the control cylinder 119. This switches the dump valve from a static mode to an operating mode causing the valve element 125 to move to close off the dump orifice and to force all high pressure water from conduit 141 through the valve body and through the high pressure water outlet 117 and conduit 113 to the inlet 111 at the top of the stationary spindle 47.

Thus, the water under high pressure is now delivered through the spindle and to the power rotated bushing body 59 for delivering high pressure water through the nozzle arms 89 and through the respective nozzles 93 at a predetermined pressure in the range up to 10,000 psi.

At the same time as the water is delivered under such high pressure, the air motor is effective to provide continuous rotation of the body 159 so that there is, in effect, a scouring action of the streams or jets of high pressure water in a predetermined pattern directed down onto the floor surface or grating surface directly below the spray enclosure.

The present invention is also directed to a method of removing paint from floor surfaces and floor gratings and as equivalent thereto, a method which provides for the removal of dirt or oil or other accumulations upon any floor surface. The method includes the following steps:

1. Supporting one or more or a series of high pressure water jets above a floor surface or a grating within the floor surface.

2. A further step includes directing said jets of high pressure water so as to impinge upon said floor surface and grating and confining said jets to a limited area;

3. As a third step, simultaneously rotating said water jets to sweep over surface areas of said floor surface and gratings and;

4. The final step of movably transporting the water jets over and along surface portions of said floor and grating for, in effect, blasting and removing paint particles and other accumulations from surfaces thereof.

It is the rotary high pressure spray action of the jets which cleans the sides and top of the grating components or the floor surface as the unit moves in any direction thereover. The operator moves the spin jet floor cleaner at a rate necessary for cleaning floor grates and floor surfaces as required.

The high pressure air source at 149 supplies air at 60 to 90 psi for rotating the high pressure nozzles and for controlling the high pressure dump valve.

Having described my invention, reference should now be had to the following claims.

I claim:

1. A method for removing paint from floors and floor gratings by using a cleaning device having a plurality of high pressure water nozzles mounted within a hollow spray enclosure and discharging a stream of water under high pressure through said water nozzles towards a floor and floor grating wherein said cleaning device includes a fixed spindle mounted to said hollow spray enclosure, with said water nozzles being mounted to a tubular body which is rotatably mounted on said spindle, a dump valve including a movable valve element which is normally biased to a first position to direct said water through an orifice into said hollow spray enclosure, a pneumatic power means rotatably driving said tubular body, and said pneumatic power means being operably connected to said dump valve for shifting said valve element to a second position, to close said orifice and direct all of said water through a vertical bore within said spindle comprising:

directing said stream of high pressure water through said orifice into said hollow spray enclosure when said valve element is in its first position and said tubular body is not being driven for rotation by said pneumatic power means;

directing all of said stream of high pressure water downwardly through said vertical bore within said fixed spindle and into a plurality of radial discharge ports at the lower end of said vertical bore only when said pneumatic power means is rotatably driving said tubular body and said valve element is in its second position;

said tubular body having an annular water chamber in close proximity to said radial discharge ports, said annular water chamber receiving said downwardly directed stream of high pressure water and directing said stream of high pressure water radially outward through a plurality of angularly disposed water nozzles whereby high pressure water jets impinge onto the floor and floor grating;

permitting movement of high pressure water between said tubular body and said spindle to thereby lubricate the rotative movement of said tubular body on said spindle;

and movably transporting said water jets over and along surface portions of said floor and floor grating for forcefully and operatively impinging upon the surface portions of said floor and floor grating.

* * * * *